United States Patent [19]

Nishimura

[11] 4,221,364

[45] Sep. 9, 1980

[54] CHAIN BLOCK

[75] Inventor: Yosaku Nishimura, Osaka, Japan

[73] Assignee: Kabushiki Kaisha Toa Kiaki Seisakusho, Osaka, Japan

[21] Appl. No.: 63,550

[22] Filed: Aug. 3, 1979

[30] Foreign Application Priority Data

Aug. 7, 1978 [JP] Japan ..... 53-108667

[51] Int. Cl.[2] ..... B66D 1/00

[52] U.S. Cl. ..... 254/338; 254/358; 24/116 R; 403/157; 403/73

[58] Field of Search ..... 254/167, 169, 192, 197, 254/139

[56] References Cited

U.S. PATENT DOCUMENTS

| | | | |
|---|---|---|---|
| 916,111 | 3/1909 | Cross | 254/167 |
| 1,458,354 | 6/1923 | Neller | 254/167 |
| 2,261,963 | 11/1941 | Coffing | 254/167 |
| 2,656,150 | 10/1953 | Lock | 254/167 |

*Primary Examiner*—Edward J. McCarthy
*Attorney, Agent, or Firm*—Mason, Fenwick & Lawrence

[57] ABSTRACT

A chain block having an attaching member connected to the load-free end link of a load chain entrained around a load sprocket wheel rotatably supported by and between a pair of lateral plates. The attaching member is pivotally mounted at one end portion thereof between the pair of lateral plates by a pin which extends through the attaching member and the pair of lateral plates. The other end portion of the attaching member at which the latter is connected to the load-free end link of the load chain is formed on both sides thereof with boss-like projections adapted to abut against the peripheries of the pair of lateral plates to thereby increase the strength with which the load-free end link of the load chain is attached to the pair of lateral plates, thereby improving the safety of the chain block.

2 Claims, 4 Drawing Figures

CHAIN BLOCK

BACKGROUND OF THE INVENTION

The present invention relates to a chain block and particularly to improvements in a construction for attaching the load-free end link of a load chain.

The chain block which has heretofore been in general use, as shown in FIG. 1, comprises a load sprocket wheel 4 rotatably supported between a pair of lateral plates 2 and 3 having a suspension hook 1 attached thereto, and a load chain 5 entrained around said load sprocket wheel 4, said load chain having a load-free end link 5*a* attached to the lateral plates by a pin 6 extending therethrough, a load hook 7 connected to the load end link 5*b* of said load chain, a hand-operated sprocket wheel 9 which is rotated by a hand-operated chain 8 to rotate the load sprocket wheel 4 through a brake mechanism 10 and a speed reducing gear mechanism 11 to thereby lift and lower load hook 7 connected to the load chain 5. Since the load-free end link 5*a* of the load chain 5 is locked to the attaching pin 6, the lowering of the load chain 5 to the fullest extent will result in the load chain 5 being stretched between the pin 6 and the load sprocket wheel 4, preventing any further lowering. In this connection, it often occurs that not knowing that the lowering limit has already been reached, the operator further pulls the hand-operated chain 8 strongly in the lowering direction. In such cases, the suspended load hooked by the load hook 5 is transmitted through the load-free end link 5*a* of the load chain 5 to act concentratedly on the middle portion of the attaching pin 6 between the lateral plates 6 to exert a heavy bending moment on the attaching pin 6. This sometimes breaks the attaching pin 6, releasing the suspended load to fall downward to injure or even kill the operator or other persons. Guide rollers 12 for the load chain 5 are disposed on both sides of the load sprocket wheel 4 and are strongly pressed by the load chain 5, so that it is necessary for the guide rollers 12 and the support structure therefor to have a strength several times as high as the value usually required by the guide rollers themselves. The load chain 5 strongly pressing the guide rollers 12 is liable to come in abnormal contact therewith and break, causing an accident.

On the other hand, devices intended to eliminate the above-described drawbacks are known, as found, for example, in Japanese Utility Model Publication Nos. 34392/1973 and 34391/1973. According to these devices, the load-free end link of the load chain is locked to the front end of a lever-shaped support which is pivotally mounted at one end thereof between a pair of lateral plates so that when the load chain is lowered to the fullest extent, the lever-shaped support contacts a guide roller to stretch the load chain without bringing the load-free portion of the load chain into contact with said guide roller, and any further lowering of the load chain is prevented by the pressure contact of said lever-shaped support with the guide roller. Therefore, since the load-free end portion of the load chain is not subjected to an excessive load which would be exerted if it contacts the guide roller, the attaching strength is increased. However, the lever-shaped support exerts the full load acting on the load chain on the guide roller it contacts. As a result, it is necessary for the guide roller and the support structure therefor to have a strength several times as high as the value heretofore required.

SUMMARY OF THE INVENTION

An object of the invention is to increase the strength with which a chain block, particularly the load chain thereof is attached to a pair of lateral plates, to prevent accidents from occurring when the load chain is lowered to the fullest extent, and to improve safety.

Another object of the invention is to protect the guide roller from being subjected to an abnormal load when the load chain is lowered to the fullest extent, thereby precluding damage and other accidents to the guide roller. According to the invention, one end of an attaching member connected to the load-free end link of a load chain entrained around a load sprocket wheel is disposed between a pair of lateral plates between which said load sprocket wheel is rotatably supported, said attaching member being pivotally mounted between said lateral plates by a pin extending through the lateral plates and said one end portion of the attaching member.

The other end of the attaching member is formed with a slot extending at right angles to the axis of said attaching pin to receive said load-free end link of the load chain. Thus, the attaching member is connected to the load chain by a connecting pin parallel to the attaching pin and extending through the other end portion of the attaching member.

Said other end portion of the attaching member through which the connecting pin extends is integrally formed with boss-like projections extending axially of the connecting pin. The dimension between the end surfaces of the boss-like projections is equal to or greater than the dimension between the end surfaces of the pair of lateral plates so that with the load chain lowered to the fullest extent, the boss-like projections on the end surfaces of the attaching member abut against the peripheral edges of said two lateral plates, thereby preventing the attaching member from further turning around the axis of the attaching pin.

With the arrangement described above, the load acting on the connection between the load chain and the pair of lateral plates acts as a bending moment on both the connecting pin and the attaching pin. Thus, as compared with the conventional arrangement wherein the load acts concentratedly on a single attaching pin, the connecting and attaching pins each bear only less than half the load, so that even if the connecting and attaching pins are not so much increased in diameter, the strength with which the load chain is attached to the lateral plates can be greately increased.

Further, since the load-free end link of the load chain is received in the slot of the other end portion of the attaching member having boss-like projections and is connected to the attaching member by the connecting pin extending through said other end portion, the selection of the width of said slot which is slightly greater than or approximately equal to the wire diameter of the load chain can reduce the distance of the point of action from the connecting pin in the resulting bending moment, so that said bending moment itself is small. The boss-like projections make up for the want of the strength of the connecting pin, and since their diameter is, of course, large, they assure a sufficiently high strength against the bending moment due to the distance between their point of contact with the lateral plates and the point of action of the load where the load chain is engaged with the connecting pin.

On the other hand, by dimensioning the one end portion of the attaching member, namely, the portion interposed between the pair of lateral plates, such that their width is approximately equal to or slightly smaller than the spacing between said lateral plates, it is possible to greately reduce the bending moment acting on the attaching pin as compared with the conventional arrangement, thus assuring a sufficiently high attaching straight therefor. Thus, it is possible to protect the attaching area between the load chain and the lateral plates against damage or rupture due to erroneous operation on the chain block, particularly on the hand-operated chain thereof.

The provision of the attaching member in the attaching area between the load chain and the lateral plates alows the position of attachment of the load-free end link of the load chain to be suitably changed from the conventional position of the attaching pin. Thereby, the position of the load-free end link of the load chain reached when the load chain is lowered to the fullest extent can be changed to eliminate the high lateral pressures on the guide rollers for the load chain. Accordingly, the disadvantage of having high pressures on the guide rollers and on the various parts of the attaching structure therefor is eliminated, allowing the design strength to be safely reduced to the minimum necessary for performing the function of a guide, enabling the guide rollers and the attaching structure to be light in weight.

Other objects and features of the invention will be made clear from the description of the preferred embodiment of the invention to be given below.

DESCRIPTION OF THE PREFERRED EMBODIMENT

Figure 1:
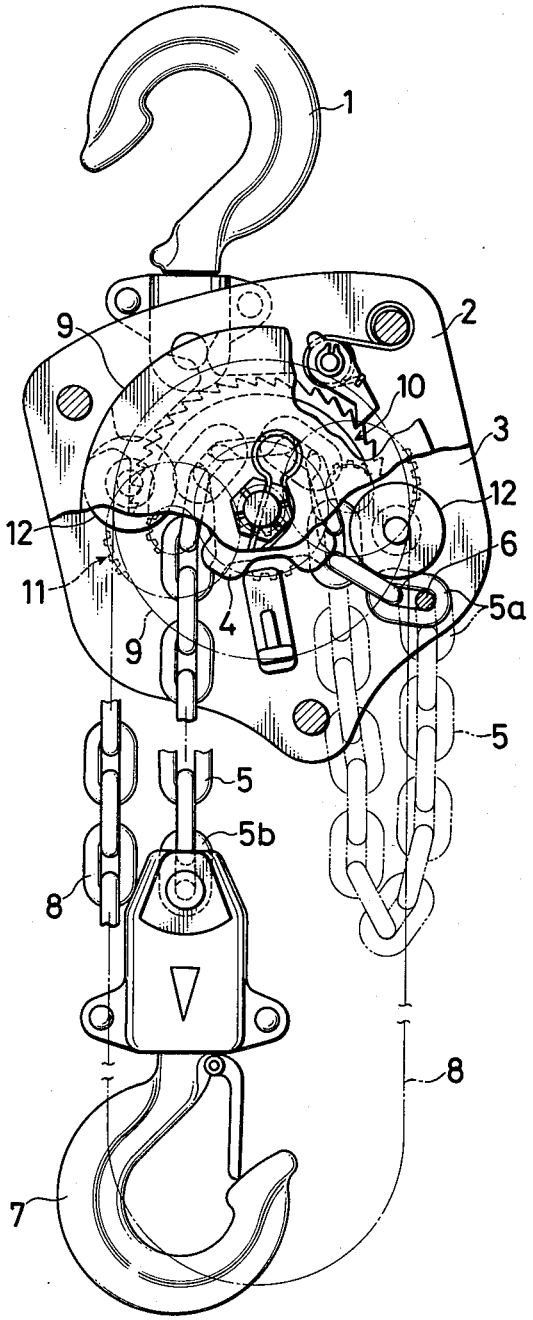
FIG. 1 is a side view of a conventional chain block, with some portions broken away.
Figure 2:
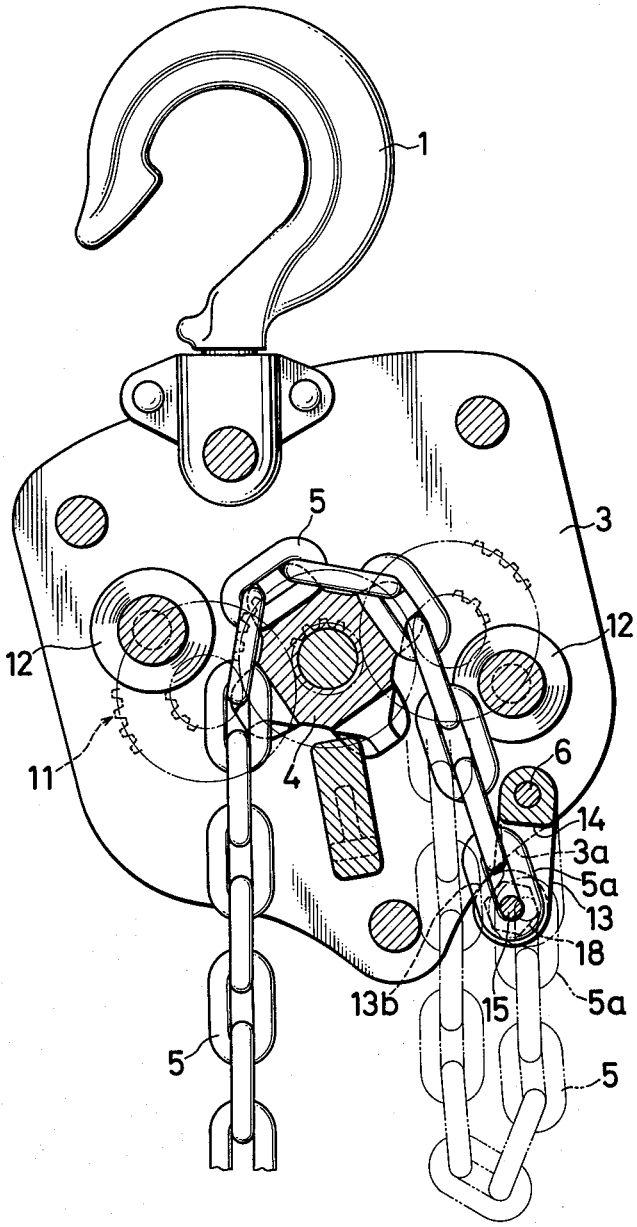
FIG. 2 is a cross-sectional view showing an embodiment of the invention.
Figure 3:
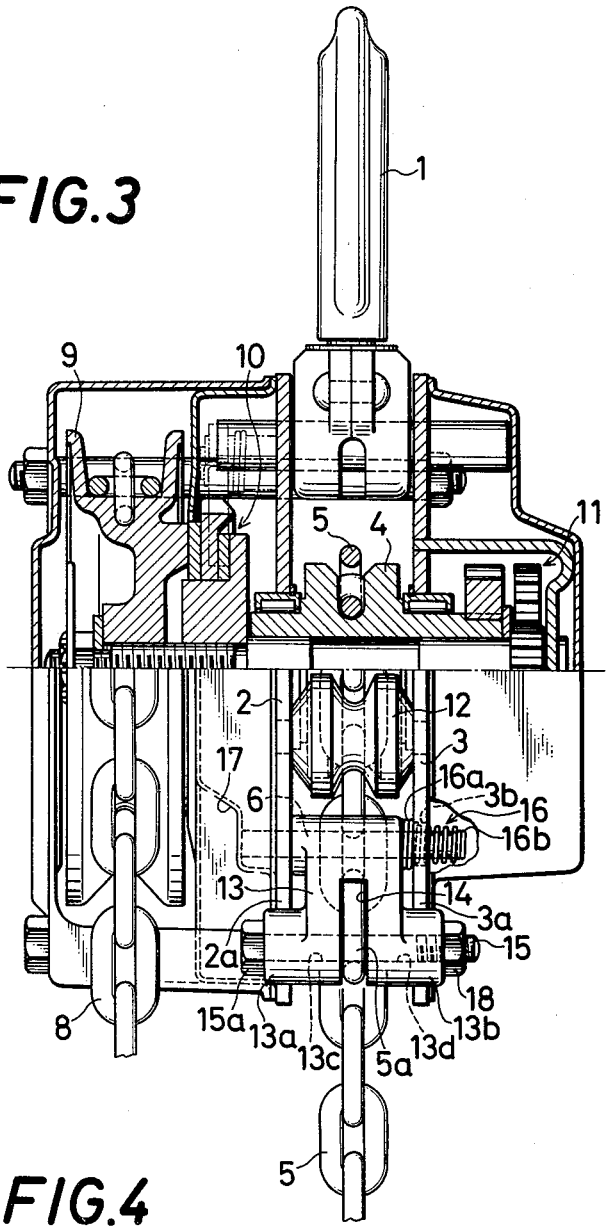
FIG. 3 is a front view, partly in longitudinal section, of said embodiment.
Figure 4:
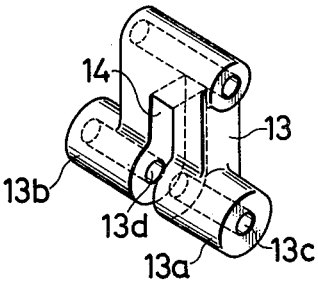
FIG. 4 is a perspective view of an attaching member.

Referring to FIGS. 2 through 4 showing an embodiment of the invention, an attaching member 13 having its one end portion interposed between a pair of lateral plates 2 and 3 is pivotally supported between said lateral plates by an attaching pin 6 extending through said attaching member and lateral plates. The load-free end link 5*a* of a load chain 5 is received in a slot 14 formed in the other end portion of said attaching member 13, while a connecting pin 15 extending through the other end portion of the attaching member 14 is inserted into said end link 5*a*, whereby the attaching member 13 and the load chain 5 are connected together. The attaching member 13 is integrally formed with boss-like projections 13*a* and 13*b* extending axially of connecting pin receiving holes 13*c* and 13*d* in said other end portion, the dimension between the end surfaces of said boss-like projections being equal to or greater then the dimension between the end surfaces of the pair of lateral plates 3 and 4 so that said boss-like projections 13*a* and 13*b* will abut against the peripheral edges 2*a* and 3*a* of said pair of lateral plates 2 and 3 to prevent the turning of the attaching member 13 around the axis of the pin 6.

The attaching member 13 is, for example, a casting having a shape shown in FIG. 4. The slot 14 has a width somewhat greater than the wire diameter of the load-free end link 5*a* of the load chain 5, and the portion interposed between the lateral plates 2 and 3 is given the greatest width to prevent chattering thereof between the lateral plates 2 and 3, as shown in FIG. 3. The attaching pin 6 supporting the attaching member 13 is inserted into the pin receiving hole 3*b* of one lateral plate 3 from the inside until its one end engages a support spring 16 having a large diameter portion 16*a* engaged with the inner surface of the lateral plate 3, so that the attaching pin 6 receives at its one end a pressure from the small diameter portion 16*b* of the support spring 16 and is urged against the inner surface of a brake cover 17 to be prevented from slipping off. The large diameter portion 16*a* of the spring 16 is positioned between one lateral plate 3 and the attaching member 13 to prevent the chattering of the attaching member. The connecting pin 15 is headed as at 15*a* and it is inserted into the front end of the attaching member 13 and locked in position by a nut 18.

Thus, the load-free side of the load chain 4 along with the attaching member 13, as shown in phantom lines in FIG. 2, is freely hanging between the load sprocket wheel 4 and the attaching pin 6, with the load-free end link 5*a*, the connecting pin 15, the attaching member 13 and the attaching pin 6 being subjected to their respective self-weights alone.

If the load chain 5 is lowered to the fullest extent, the load-free side of the load chain 5 is stretched to cause the load-free end link 5*a* to pull up the connecting pin 15, turning the attaching member 13 to the solid line position in FIG. 2, so that the boss-like projections 13*a* and 13*b* abut against the peripheral edges 2*a* and 3*a* of the lateral plates 2 and 3, thereby preventing further lowering of the load chain.

In this state, if the hand-operated chain 8 is operated in the lowering direction, the suspended load will act on the connecting pin 15 through the load-free end link 5*a* of the load chain 5 and is shared between the attaching member 13, the boss-like projections 13*a* and 13*b* contacting the outer peripheries 2*a* and 3*a* thereof, and the attaching pin 6. The connecting pin 15 and the boss-like projections 13*a* and 13*b* are subjected to relatively great forces, but since the connecting pin 15 is supported at its opposite ends within the narrow slot 14 only just receiving the end link 5*a* of the load chain 15, the bending moment due to said force is small, while the boss-like projections 13*a* and 13*b* are abutting against the peripheral edges 2*a* and 3*a* and the bending moment due to the force acting thereon is very small. Further, since the boss-like projections 13*a* and 13*b* are cylindrical, their strength is also high. As a result, even if an abnormal load due to said excessive lowering is encountered, there will be no danger of the parts connected to the load-free end link 5*a* being damaged or ruptured.

On the other hand, the load-free side of the load chain 5 stretched between the connecting pin 15 and the load chain 4 by such abnormal load will not be pressed against the associated guide roller 12, as shown in solid lines in FIG. 2, because of the positioning of the pin 15 by the attaching member 13.

What is claimed is:

1. A chain block comprising:

a load chain, a load sprocket wheel having said load chain entrained therearound, a pair of lateral plates rotatably supporting said load sprocket wheel, an attaching member having one end portion thereof interposed between said pair of lateral plates, a connecting pin extending through the load-free end link of said load chain and through the other end portion of said attaching member, said attaching member having a slot formed at the other end portion thereof for receiving said load-free end link and also having boss-like projections integrally formed on both sides of said other end portion projecting axially of said connecting pin, the dimension between the end surfaces of said boss-like projections being not smaller than the dimension between the end surfaces of said lateral plates so that when the load chain is lowered to the fullest extent, said projections abut against the peripheral edges of said lateral plates, an attaching pin extending through said pair of lateral plates and through one end portion of said attaching member to pivotally mount said attaching member, guide rollers for guiding said load chain, said guide rollers being rotatably supported between said lateral plates.

2. A chain block as set forth in claim 1, wherein said attaching member regulates the position of said load-free end link so that said load chain will be positioned such that it will not exert lateral pressures on said guide rollers when the load chain is lowered to the fullest extent.

* * * * *